US008849153B2

(12) United States Patent
Goto

(10) Patent No.: US 8,849,153 B2
(45) Date of Patent: Sep. 30, 2014

(54) DEVELOPMENT DEVICE AND IMAGE FORMATION APPARATUS

(71) Applicant: Oki Data Corporation, Tokyo (JP)

(72) Inventor: Yoshihiro Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 118 days.

(21) Appl. No.: 13/623,283

(22) Filed: Sep. 20, 2012

(65) Prior Publication Data

US 2013/0071138 A1 Mar. 21, 2013

(30) Foreign Application Priority Data

Sep. 20, 2011 (JP) ..... 2011-204030

(51) Int. Cl.
*G03G 15/08* (2006.01)

(52) U.S. Cl.
CPC .... *G03G 15/0812* (2013.01); *G03G 2215/0141* (2013.01)
USPC ..... 399/103

(58) Field of Classification Search
CPC ..... G03G 15/0881; G03G 15/0898
USPC ..... 399/102, 103, 105, 106
See application file for complete search history.

(56) References Cited

U.S. PATENT DOCUMENTS 6,341,206 B1 * 1/2002 Yamaguchi et al. ..... 399/103
7,693,447 B2 * 4/2010 Lee et al. ..... 399/103

FOREIGN PATENT DOCUMENTS

JP 2001-060041 A 3/2001
JP 2001-125373 A 5/2001
JP 2007-121989 A 5/2007
JP 2009-265325 A 11/2009

* cited by examiner

*Primary Examiner* — David Gray
*Assistant Examiner* — Michael Harriosn
(74) *Attorney, Agent, or Firm* — Marvin A. Motsenbocker; Mots Law, PLLC

(57) ABSTRACT

A development device includes a regulation member partially defining a developer room and configured to regulate the thickness of a developer layer on a developer carrier, the regulation member including a regulation edge facing the developer carrier to control the thickness of the developer layer on the developer carrier, and an end facing an inner wall surface of the developer room; a first seal member attached to the inner wall surface of the developer room at a position facing the end of the regulation member; and a second seal member attached to the regulation member at a portion in the vicinity of the end of the regulation member and being in contact with the first seal member to seal between the first seal member and the end of the regulation member. The second seal member is lower in hardness than the first seal member.

22 Claims, 10 Drawing Sheets

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2011-204030 filed on Sep. 20, 2011, entitled "DEVELOPMENT DEVICE AND IMAGE FORMATION APPARATUS", the entire contents of which are incorporated herein by reference.

BACKGROUND OF THE INVENTION

Field of the Invention

This disclosure relates to a development device and an image formation apparatus.

A conventional development device includes: a developer carrier configured to develop an electrostatic latent image formed on an electrostatic latent image carrier by attaching toner serving as a developer; and a development blade as a regulation member configured to control the layer thickness of the toner on the developer carrier. Some of such development devices prevent toner leaking from a toner room which contains the toner therein by bringing both ends of the development blade into contact with seal members provided to both side surfaces of the toner room (see, for example, Patent Document 1: Japanese Patent Application Publication No. 2009-265325).

SUMMARY OF THE INVENTION

In the development device having the above configuration, the ends of the development blade receive pressure from the seal members attached to the side surfaces of the toner room. Therefore, the toner layer thickness around the ends of the development blade may be different from that around a center region of the development blade.

An objective of an embodiment of the invention is to prevent unevenness of the toner layer thickness between the end regions and the center region of a regulation member such as the development blade.

A first aspect of the invention is a development device including: a regulation member partially defining a developer room and configured to regulate the thickness of a developer layer on a developer carrier, the regulation member including a regulation part facing the developer carrier to control the thickness of the developer layer on the developer carrier, and at least one of both ends facing an inner wall surface of the developer room; a first seal member attached to the inner wall surface of the developer room at a position facing the at least one of both ends of the regulation member; and a second seal member attached to the regulation member at a portion of the regulation member in a vicinity of the at least one of both ends of the regulation member and being in contact with the first seal member to seal between the first seal member and the at least one of both ends of the regulation member. The second seal member is lower in hardness than the first seal member.

A second aspect of the invention is an image formation apparatus including: an exposure device configured to emit light based on image data to form an electrostatic latent image; the development device, according to the first aspect, configured to develop the electrostatic latent image formed by the exposure device, to form a developer image; a transfer device configured to transfer the developer image onto a recording sheet; and a fixation device configured to fix the transferred developer image onto the recording sheet.

According to the aspects above, a difference in the thickness of a toner layer between the end regions and the center region of the regulation member can be prevented.

DETAILED DESCRIPTION OF EMBODIMENTS

Figure 1:
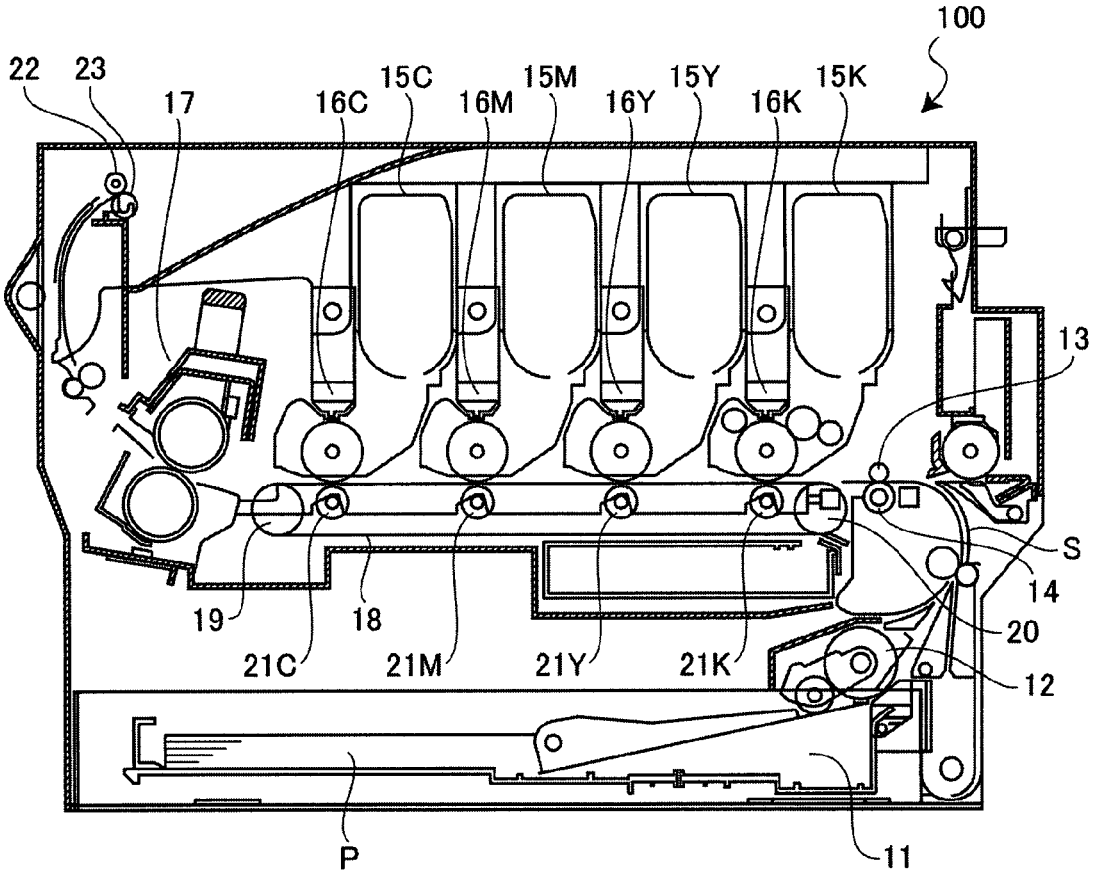
FIG. 1 is a schematic sectional view illustrating the schematic configuration of a printer according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

[First Embodiment]

In a description of a first embodiment, a printer as an image formation apparatus to which a development device according to the invention is applied is described first, and the development device according to the invention is described next.

FIG. 1 is a schematic sectional view illustrating the schematic configuration of printer 100 according to the invention. Printer 100 is a color printer capable of forming a color image by superimposing toner of black (K), toner of yellow (Y), toner of magenta (M), and toner of cyan (C), the toner serving as a developer. Printer 100 implementing such a capability has development devices 15K, 15Y, 15M, and 15C and fixation device 17 arranged along sheet transport path S formed into an almost S shape having tray 11 as a start point and an ejection roller 23 as an end point.

Tray 11 internally houses stacked sheets P, and is attached to a lower part of printer 100 detachably. Hopping roller 12 picks up an uppermost one of sheets P housed in tray 11 one at a time, and feeds it to sheet transport path S.

Forming a pair with registration roller (feed roller) 14, registration roller (pressure roller) 13 corrects the orientation of sheet P fed by tray 11 and transports sheet P to transfer belt 18.

Development devices 15K, 15Y, 15M, and 15C correspond to toner of black (K), toner of yellow (Y), toner of magenta (M), and toner of cyan (C), respectively, and are attached along sheet transport path S detachably. Development devices 15K, 15Y, 15M, and 15C are each configured to develop a toner image, which is a developer image, by attaching toner to an electrostatic latent image formed on photosensitive drum 2 irradiated by a light source, such as a light emitting diode (LED) device (not shown), of exposure head 16K, 16Y, 16M, or 16C which is an exposure device to be described later. A detailed description is given later as to development devices 15K, 15Y, 15M, and 15C.

Exposure heads 16K, 16Y, 16M, and 16C are LED heads each having a light emitting device such as an LED device and a lens array, and are each arranged at such a position that irradiation light outputted from the LED element based on image information may form an image on the surface of photosensitive drum 2.

Fixation device 17 is arranged downstream of development devices 15K, 15Y, 15M, and 15C in paper transport path S, and includes a heat roller, a backup roller, a thermistor, and the like. The heat roller is formed by coating a hollow cylindrical core bar made of aluminum, for example, with a heat-resistant elastic layer made of silicone rubber, and then covering this with a PFA (a copolymer of tetrafluoroethylene and perfluoroalkylvinylether) tube. A heater such as a halogen lamp is provided inside the core bar. The backup roller is formed by coating a core bar made of aluminum, for example, with a heat-resistant elastic layer made of silicone rubber and then by covering this with a PFA tube, and is arranged so as to form a pressure contact portion between the backup roller and the heat roller. The thermistor is a device for detecting the surface temperature of the heat roller, and is arranged near the heat roller with no contact therebetween. The heat roller is controlled based on a detection result of the surface temperature of the heat roller detected by the thermistor, and thereby the surface temperature of the heat roller is maintained at a predetermined temperature. When sheet P, on which toner images formed by respective development devices 15K, 15Y, 15M, and 15C are transferred, passes through the pressure contact portion formed by the backup roller and the heat roller whose temperature is maintained at the predetermined temperature, heat and pressure are applied to sheet P, melting the toner to fix the toner images.

Transfer belt 18 is an endless belt member configured to electrostatically adsorb sheet P and transport sheet P, and lies across drive roller 19 and tension roller 20. Drive roller 19 is rotated by a driving force transmitted from a drive part (not shown), and tension roller 20 is arranged to form a pair with drive roller 19. Transfer belt 18 is driven by the rotation of drive roller 19.

Transfer rollers 21K, 21Y, 21M, and 21C are each arranged to face and be in contact with photosensitive drum 2 of development device 15K, 15Y, 15M, or 15C. A high-voltage power supply for the transfer rollers is connected to transfer roller 21K, 21Y, 21M, and 21C, and a toner image formed on photosensitive drum 2 is transferred onto sheet P by a voltage applied to transfer roller 21K, 21Y, 21M, or 21C.

Forming a pair with pinch roller 23, ejection roller 22 pinches and transports sheet P having passed fixation device 17, and ejects sheet P to a sheet stacker formed using the housing of printer 100.

Note that printer 100 includes other constituent members although they are not shown in FIG. 1. Specifically, printer 100 includes: a print controller having a read-only memory (ROM), a random access memory (RAM), a input/output port, a timer, and the like; an interface controller configured to receive print data and a control command and to control an overall sequence of printer 100 to execute print operations; a reception memory configured to temporarily store the print data inputted via the interface controller; an image data edit memory configured to receive the print data stored in the reception memory and to store an image data formed by performing edit processing on the print data; a display unit having a display device such as a liquid crystal display (LCD) configured to display the status of printer 100; an operation unit having an input unit such as a touch panel configured to receive an instruction by a user; various sensors, such as a sheet position detection sensor, a temperature and humidity sensor, and a concentration sensor, configured to monitor the operation status of printer 100; a drive controller for an exposure device configured to send exposure heads 16K, 16Y, 16M, and 16C the image data stored in the image data edit memory and to control the driving of exposure heads 16K, 16Y, 16M, and 16C; a temperature controller configured to control the temperature of fixation device 17; a sheet transport motor controller configured to control drive motors for rotating the rollers used to transport sheet P; a drive controller configured to control drive motors for rotating the various rollers, such as the photosensitive drums; a high-voltage power supply configured to apply a voltage to each roller; and the like.

Figure 2:
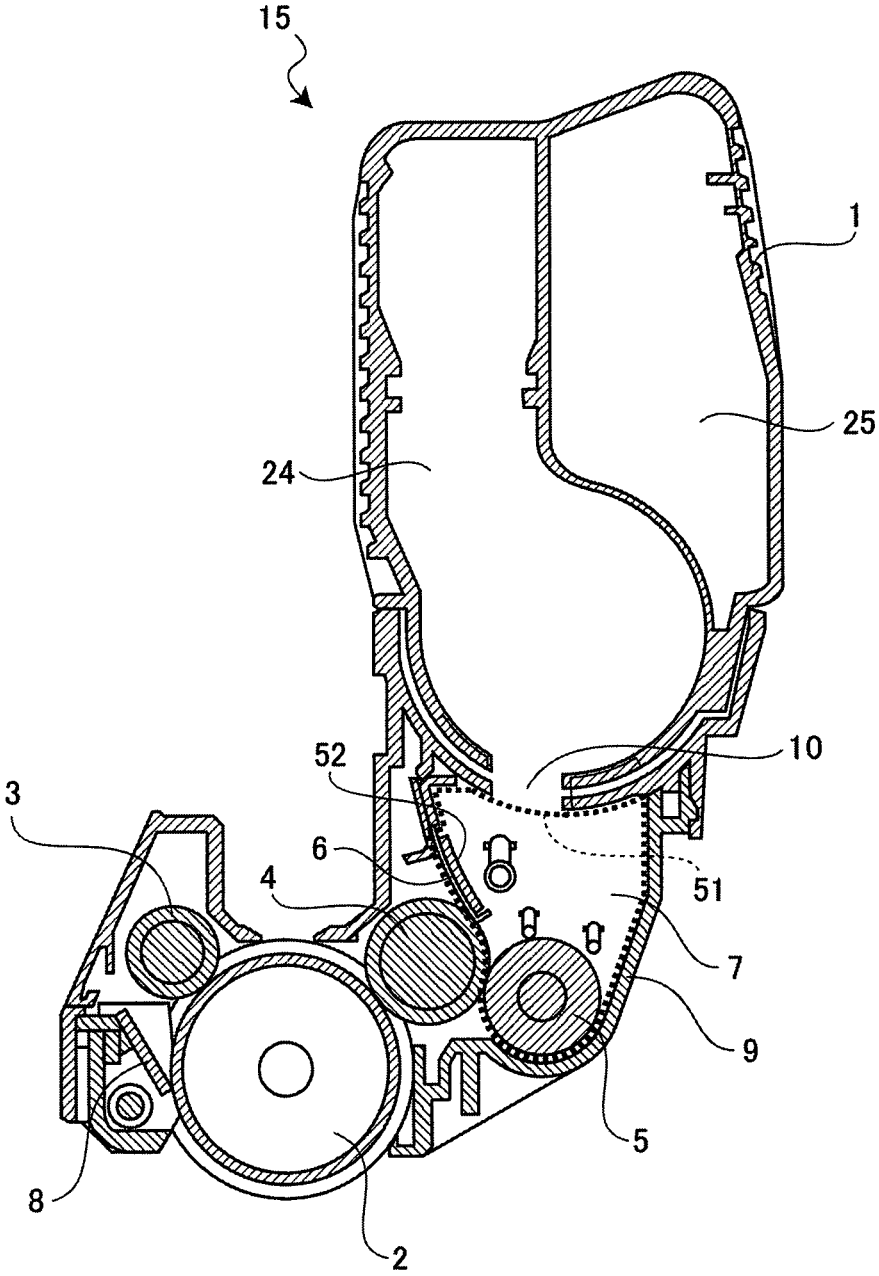
FIG. 2 is a schematic sectional view illustrating the schematic configuration of a development device.

Next, development devices 15K, 15Y, 15M, and 15C are described using the schematic sectional view of FIG. 2. Note that development devices 15K, 15Y, 15M, and 15C have the same configuration, except for the color of toner contained therein. For this reason, development devices 15K, 15Y, 15M, and 15C are described as development device 15 in the description given below.

Development device 15 according to the embodiment is formed of imaging drum unit 9 configured to develop a toner image and toner cartridge 1 configured to contain toner inside. Toner cartridge 1 is attachable to and detachable from imaging drum unit 9.

Imaging drum unit 9 includes photosensitive drum 2, charge roller 3, development roller 4 as a developer carrier, supply roller 5, development blade 6 as a regulation member, toner storage 7 as a developer room or a developer container, cleaning blade 8, first seal member 51 as a first seal, and second seal member 52 as a second seal.

Photosensitive drum 2 includes a conductive support and a photoconductive layer, and is, for example, an organic photoconductor including a metal shaft, such as aluminum shaft or the like, as a conductive support and a photoconductive layer provided on the metal shaft. The photoconductive layer may comprise a charge generation layer and a charge transport layer stacked in this order.

Charge roller 3 is configured of, for example, a metallic shaft and a semiconductor epichlorohydrin rubber. Charge roller 3 is in contact with photoconductor drum 2 with a predetermined pressure, and evenly charges the surface of photoconductor drum 2 based on a voltage applied from a high-voltage power supply (not shown).

Development roller 4 as a developer carrier is configured by, for example, arranging a urethane rubber, in which carbon black particles are dispersed, around the outer circumference of a metallic shaft made of stainless steel or the like. The surface of the urethane rubber is given an isocyanate treatment. Development roller 4 is arranged to be in pressure contact with the surface of photoconductor drum 2, and is configured to supply toner to an electrostatic latent image formed on photoconductor drum 2 to develop a toner image.

Supply roller 5 is configured by arranging a semiconductor foamed silicone sponge layer around the outer circumference of a metallic shaft made of stainless steel or the like. Supply roller 5 is in contact with development roller 4 with a predetermined amount of pressure, and is configured to supply development roller 4 with toner supplied from toner cartridge 1.

Development blade 6 as a regulation member is, for example, a plate-shaped member configured of a plate made of metal such as stainless steel. Development blade 6 is arranged such that an edge (the lower end in FIG. 2) is into contact with a predetermined position on the surface of development roller 4. When development roller 4 is rotated, development blade 6 controls the thickness of a layer of toner supplied to the surface of development roller 4 from supply roller 5 to a certain thickness. The configurations of development blade 6 and its surroundings are described in detail later.

Toner storage 7 is configured to temporarily store toner supplied from toner cartridge 1.

Cleaning blade 8 is a urethane rubber member, for example. Cleaning blade 8 is arranged such that an edge is in contact with a predetermined position on the surface of photoconductor drum 2. Cleaning blade 8 cleans the surface of photoconductor drum 2 by removing or scraping off toner remaining on the surface of photoconductor drum 2.

First seal members 51 are provided to an inner wall surface of toner storage 7, which is indicated by a broken line in FIG. 2.

Second seal members 52 are attached to development blade 6 at both (longitudinal) end portions of development blade 6, respectively. Second seal members 52 are in contact with first seal members 51. Note that second seal members 52 have a lower hardness than first seal members 51.

Toner cartridge 1 includes toner container 24 and waste toner container 25.

Toner container 24 is a hollow box-shaped member having a container space for containing unused toner. Toner supply opening 10, through which toner is supplied to toner storage 7, is formed at a lower portion of toner container 24. Toner having fallen down through toner supply opening 10 is stirred by a stir member (not shown) supported turnably, and is supplied to supply roller 5 by a transport member.

Waste toner container 25 is a box-shaped member having a container space for containing used toner collected by cleaning blade 8 and the like, and is formed integrally with toner container 24.

Figure 3:
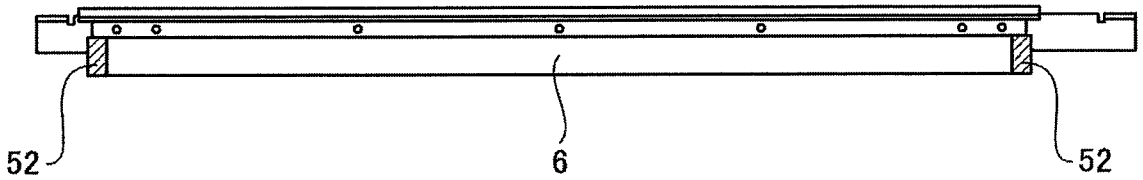
FIG. 3 is a diagram illustrating positions in a development blade where second seal members are bonded.
Figure 4:
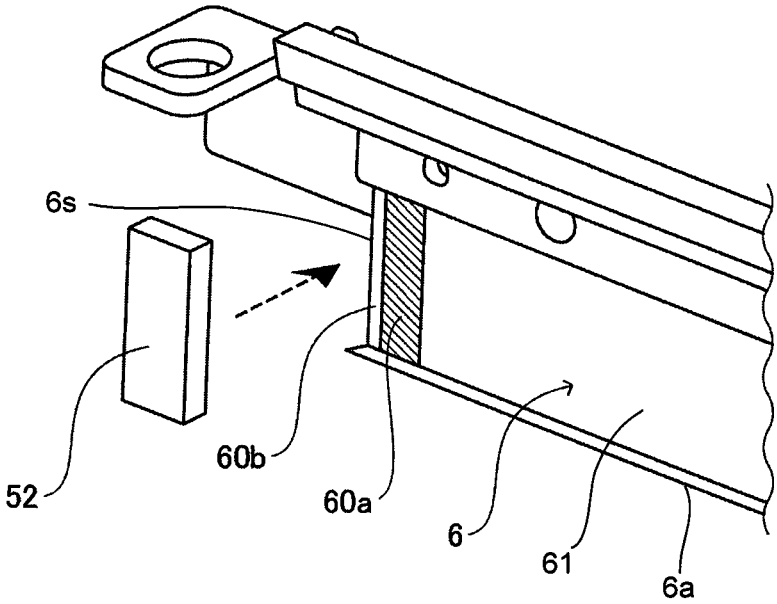
FIG. 4 is a diagram illustrating a position in the development blade where the second seal member is bonded.
Figure 5:
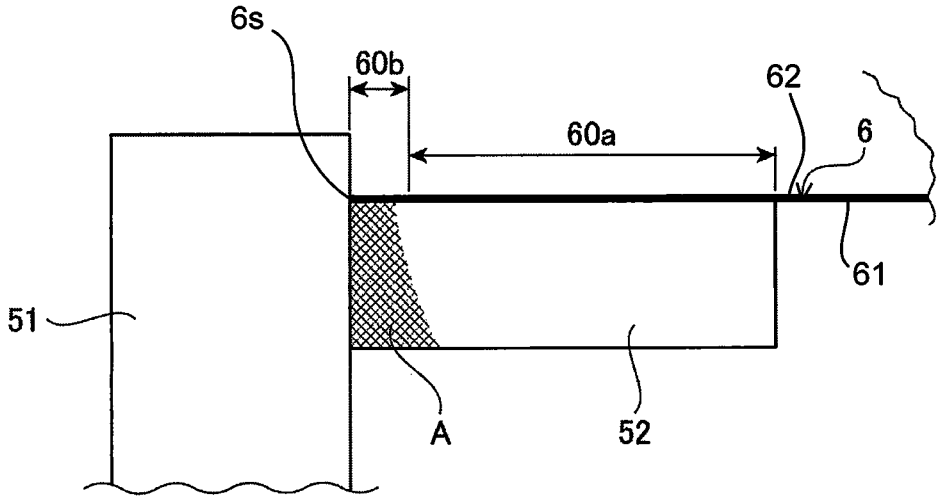
FIG. 5 is a schematic diagram illustrating how a first seal member is in contact with the second seal member.

Next, the configurations of development blade 6 as a regulation member and its surroundings are described in more detail. FIGS. 3 and 4 are diagrams illustrating positions in development blade 6 where second seal members 52 are bonded. FIG. 5 is a diagram illustrating how first seal member 51 is in contact with second seal member 52.

As described earlier, development blade 6 is, for example, a plate-shaped member configured of a plate made of metal such as stainless steel. Development blade 6 includes paired main faces 61 and 62 (e.g., paired flat plate faces) provided on opposite sides to each other (see FIG. 5). Note that one of the main faces, namely main face 61, is exposed to the inside of toner storage 7, and the other one, namely main face 62, is exposed to the outside of toner storage 7. Lower end portion **6*a* of development blade 6 is bent in a counter direction of the rotation direction of development roller 4, and is thus formed into an L shape (see FIG. 4). This lower end portion 6*a* of development blade 6 functions as a regulation part or a regulation edge configured to regulate or control the layer thickness of toner on the surface of development roller 4, for example, by being in contact with or being closely opposed to the surface of development roller 4. As shown in FIG. 5, both (longitudinal) ends 6*s* of development blade 6 (only one of them is shown in FIG. 5) face the inner wall surfaces of toner storage 7, and are in contact with first seal members 51 attached to the inner wall surfaces of toner storage 7. Thereby, first seal members 51 close gaps between the inner wall surfaces of toner storage 7 and the ends 6*s* of development blade 6 (see FIG. 5). Second seal members 52 are attached to first main face 61 of development blade 6 at positions near ends 6*s* of development blade 6, respectively (see FIG. 5). Second seal members 52 are projected or stick out from the ends 6*s* of development blade 6 (although not shown). The portions of development blade 6 where second seal members 52 are attached are each provided with a bonded area 60*a* where second seal member 52 is bonded and an unbonded area 60*b* where second seal member 52 is not bonded (see FIG. 4). Unbonded area 60*b* is provided closer to each end 6*s* of development blade 6 than bonded area 60*a*. This enables a part of second seal member 52 which corresponds to unbonded area 60*b* to freely stretch in the longitudinal direction of development blade 6**.

To be more specific, as shown in FIG. 5, since second seal member 52 is not bonded to unbonded area **60*b* of development blade 6, compressed area A is generated in second seal member 52 when second seal member 52 comes into contact with first seal member 51. The compression force in this compressed area A can further improve sealability between first seal member 51 and second seal member 52**.

Next, a description is given of an image formation process of printer 100 to which development device 15 having the configuration described above is applied.

First, when image data is inputted to printer 100, printer 100 starts the image formation process. To start the image formation process, sheet P housed in tray 11 is fed to paper transport path S one at a time by the hopping roller 12 rotated by being driven by a drive motor (not shown). Thereafter, sheet P is transported to development device 15 along paper transport path S while its orientation is corrected by registration roller 13. The image formation process described below starts at a predetermined timing before sheet P is transported to development device 15.

When image data is inputted to printer 100, photoconductor drum 2 is rotated by a drive motor (not shown) in a predetermined direction at a certain rotation speed. Then, charge roller 3 provided in contact with the surface of photoconductor drum 2 applies a charge bias, which is supplied by a high-voltage power supply for the charge roller (not shown), to the surface of photoconductor drum 2, and thus charges the surface evenly. Next, exposure head 16 provided facing photoconductor drum 2 applies light corresponding to the image data to the evenly-charged surface of photoconductive drum 2, attenuating the potential in this irradiated portion to form an electrostatic latent image.

Development roller 4 is arranged in tight contact with photoconductor drum 2, and a development bias is applied to development roller 4 by a high-voltage power supply for the development roller (not shown). Development roller 4 adsorbs toner transported by supply roller 5 to which a supply bias is applied, and rotates to transport the toner. In this rotate-and-transport step, development blade 6, arranged downstream of supply roller 5 and in pressure contact with development roller 4, forms a toner layer in which toner adsorbed on development roller 4 is smoothed out evenly.

Further, development roller 4 reversely develops the electrostatic latent image formed on photoconductor drum 2 using the toner carried by development roller 4 itself. Since a bias voltage is applied between the conductive support of photoconductor drum 2 and development roller 4 by a high-voltage power supply, a line of electric force according to the electrostatic latent image formed on photoconductor drum 2 is generated between development roller 4 and photoconductor drum 2. For this reason, by an electrostatic force, charged toner on development roller 4 is adsorbed onto the portion of photoconductor drum 2 having the latent image. This portion is developed to form a toner image.

Then, the toner image formed on photoconductor drum 2 is transferred onto sheet P by transfer roller 21 to which a voltage is applied by a high-voltage power supply (not shown).

After that, sheet P is transported to fixation device 17 including the heat roller and the backup roller. Sheet P on which the toner image is formed is transported to the pressure contact portion formed by the backup roller and the heat roller which is controlled by the temperature controller (not shown) to maintain a predetermined surface temperature. Then, the toner is melted by the heat applied by heat roller, and is further pressed in the pressure contact portion. As a result, the toner image is fixed onto sheet P.

Sheet P onto which the toner image is fixed is transported by ejection roller 22 and ejected to the sheet stacker. The image formation process thus ends.

Note that toner may remain a little on the surface of photoconductor drum 2 from which the toner image has been transferred. This remaining toner is removed by cleaning blade 8. Cleaning blade 8 is arranged in contact with a predetermined position on the surface of photoconductor drum 2. The toner remaining on the surface of photoconductor drum 2 without being transferred is removed when photoconductor drum 2 is rotated about its rotation axis with cleaning blade 8 in contact with the surface of photoconductor drum 2. Note that photoconductor drum 2 thus cleaned up is repeatedly used in an image formation process performed thereafter.

Next, a description is given of a step of bonding second seal members 52 to development blade 6 according to the embodiment. First, second seal members 52 are bonded to bonded areas 60*a* located near both ends 6*s* of first main face 61 of development blade 6. Here, second seal members 52 partially stick out from both ends 6*s* of development blade 6.

Next, effects of the embodiment are described.

Figure 6:
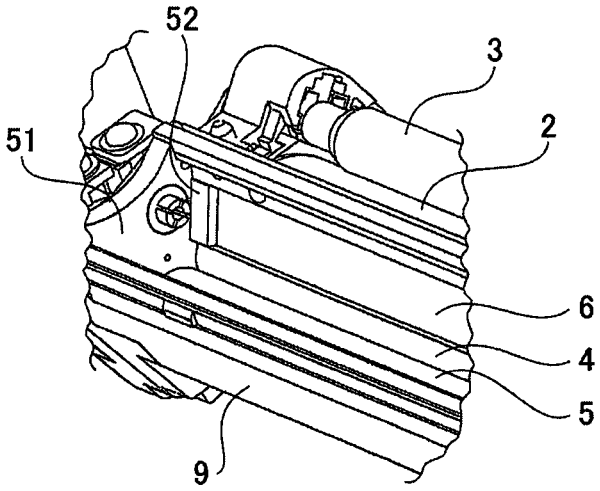
FIG. 6 is a diagram illustrating a state in which the development blade to which the second seal members are bonded is set in an imaging drum unit.

FIG. 6 is a diagram showing a state in which development blade 6 to which second seal members 52 are bonded is set in imaging drum unit 9.

In FIG. 6, an area surrounded by imaging drum unit 9, development roller 4, supply roller 5, development blade 6, and first seal member 51 corresponds to toner storage 7 shown in FIG. 2. Each end 6*s* of development blade 6 is in contact with first seal member 51. In addition, second seal member 52 is also in contact with first seal member 51.

The portion of second seal member 52 sticking out from end 6*s* of development blade 6 is compressed by being in contact with first seal member 51. Accordingly, second seal members 52 can provide higher sealability at areas corresponding to both ends 6*s* of development blade 6.

As described above, according to the first embodiment, since second seal members 52 are provided to both end portions of development blade 6, toner can be prevented from leaking from the gap between first seal member 51 and ends 6*s* of development blade 6.

In this way, in the first embodiment, second members 52 seal the gap between first seal member 51 and end 6*s* of development blade 6. For this reason, by pressing end 6*s* of development blade 6 hard to first seal member 51, the space between first seal member 51 and ends 6*s* of development blade 6 does not need to be sealed. Accordingly, pressure between first seal member 51 and ends 6*s* of development blade 6 can be reduced or eliminated, so that ends 6*s* of the development blade are less likely to be restricted by first seal members 51. To be more specific, the motion of development blade 6 (i.e., pressing the surface of development roller 4) is less likely to be impeded by first seal members 51. This enables development blade 6 to make the layer thickness of the toner on the surface of development roller 4 substantially even throughout the entire longitudinal length of development roller 4.

In addition, since second seal members 52 are softer (lower in hardness) than first seal members 51, the motion of development blade 6 (i.e., pressing the surface of development roller 4) is less likely to be impeded.

In other words, second seal members 52 are hard near the portion in contact with first seal members 51 (namely, compressed area A) because second seal members 52 are compressed there, but remain soft (low in hardness) at portions other than compressed areas A. For this reason, a repulsive force that second seal members 52 receive from first seal members 51 is dispersed in bonded area 60*a* of development blade 6 through the soft portions of second seal members 52. This can make it less likely for ends 6*s* of development blade 6 to be restricted by first seal members 51.

[Second Embodiment]

In the description of a second embodiment, portions that are the same as those of the first embodiment are given the same reference numerals, and are not described again. Only portions different from the first embodiment are described.

Figure 7:
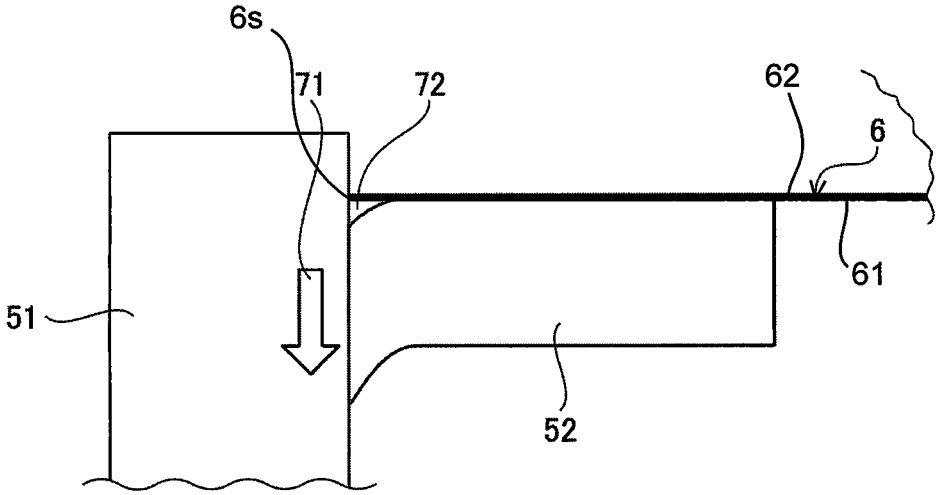
FIG. 7 is a schematic diagram illustrating how the first seal member is in contact with the second seal member.

As shown in FIG. 7, when development blade 6 of the first embodiment is set in imaging drum unit 9, a friction force is likely to be generated in the direction indicated by arrow 71 because second seal member 52 comes into contact with first seal member 51 while being compressed. Toner might leak through space 72 generated by the deformation of second seal member 52. To avoid this, in the second embodiment, thin-layered film 53 as a film member is provided to a portion of second seal member 52 which comes into contact with first seal member 51. Such a mode is now described.

Figure 8:
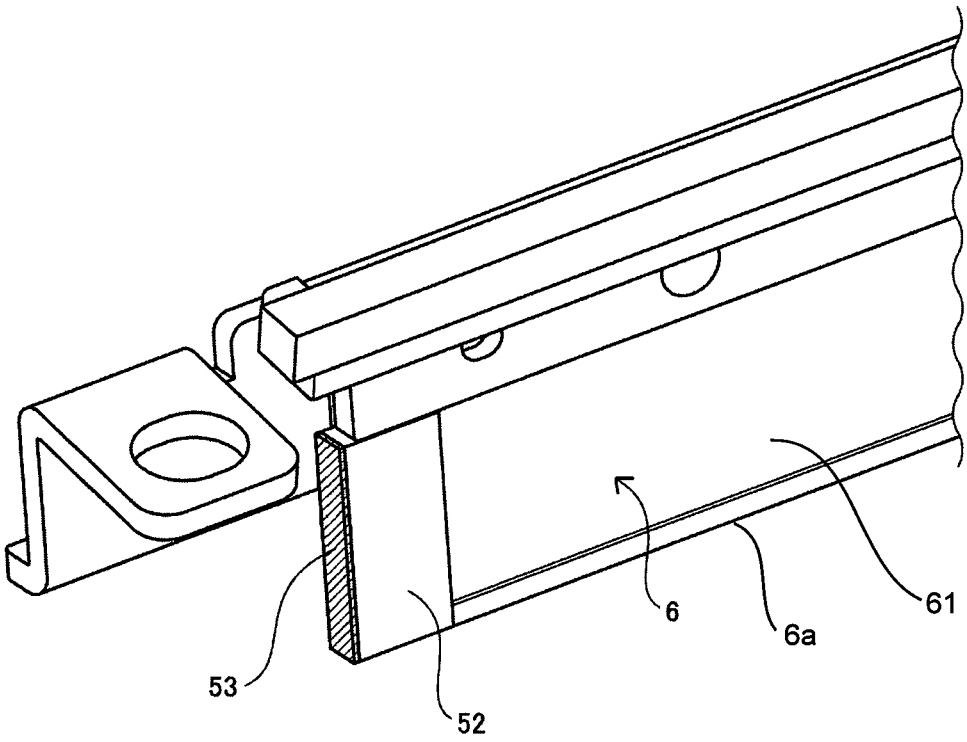
FIG. 8 is a perspective view of a part having a development blade according to a second embodiment, the view illustrating a thin-layer film member provided to a surface of a second seal member, which comes into contact with a first seal member.

FIG. 8 is a partial perspective view of development blade 6, illustrating thin-layered film 53 provided to a portion of second seal member 52 which comes into contact with first seal member 51. Film 53 is a thin-layered film member provided to the outer end of each second seal member 52 (i.e., a surface of second seal member 52 which comes into contact with first seal member 51).

Figure 9:
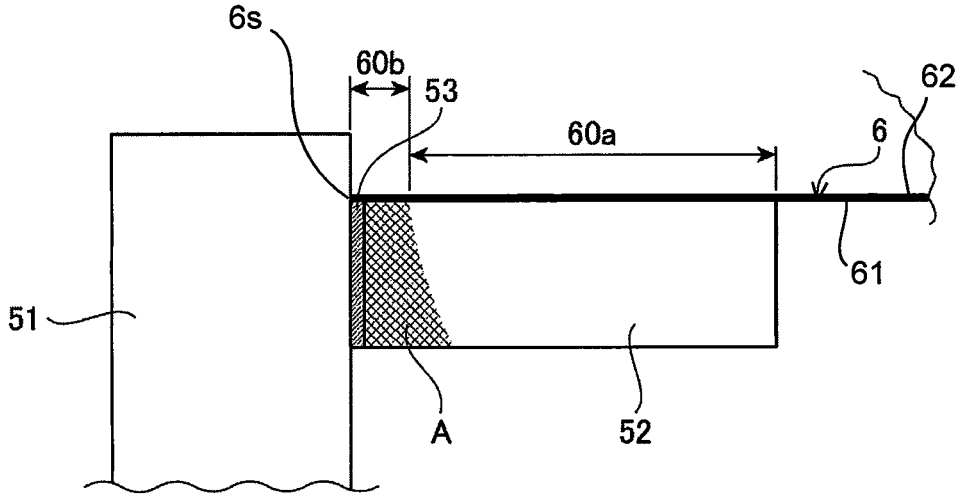
FIG. 9 is a schematic diagram illustrating how the first seal member is in contact with the second seal member.

As in the first embodiment, second seal member 52 is not bonded to the unbonded area 60*b*, as shown in FIG. 9. Since second seal member 52 comes into contact with first seal member 51 with film 53 interposed therebetween, a compression force can be generated in compression area A to further improve sealability between first seal member 51 and second seal member 52.

Figure 10:
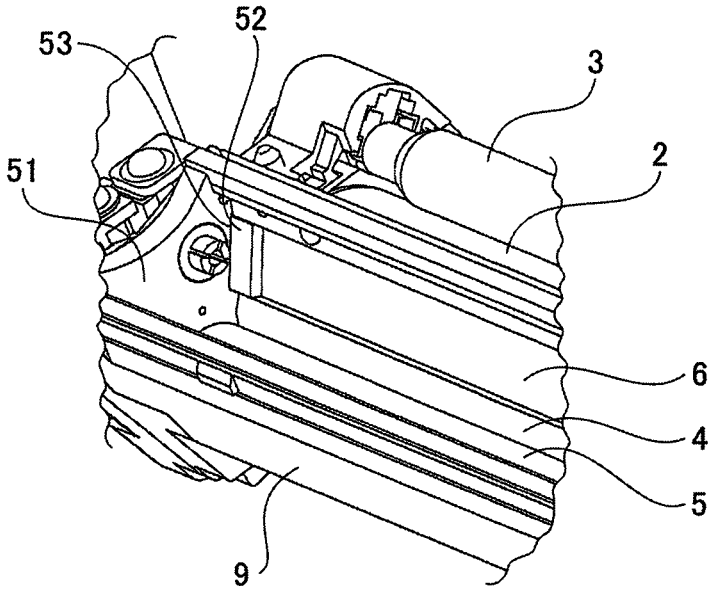
FIG. 10 is a diagram illustrating s state in which the development blade to which the second seal members are bonded is set in an imaging drum unit.

FIG. 10 is a diagram showing a state in which development blade 6, including film 53 on a surface of second seal member 52 which comes into contact with first seal member 51, is set in imaging drum unit 9.

In FIG. 10, an area surrounded by imaging drum unit 9, development roller 4, supply roller 5, development blade 6, and first seal member 51 corresponds to toner storage 7 shown in FIG. 2. As in the first embodiment, although each end 6*s* of development blade 6 is in contact with first seal member 51, since second seal member 52 is softer (lower in hardness) than first seal member 51, the influence of first seal member 51 on second seal member 52, which restricts the motion of development blade 6 (i.e., pressing the surface of development roller 4) can be reduced. Moreover, since film 53 is provided to the end of second seal member 52 (a surface of second seal member 52 which comes into contact with first seal member 51), the surface coming into contact with first seal member 51 is smooth, decreasing a friction force generated in the direction indicated by arrow 71 shown in FIG. 7 at the time of, or after, setting development blade 6 in imaging drum unit 9.

As described above, in addition to the effect provided by the first embodiment, the second embodiment can provide an effect of decreasing a friction force generated in the contact surface between first seal member 51 and second seal member 52. This can prevent the formation of a space which leads to toner leakage.

Although end 6*s* of development blade 6 is in contact with first seal member 51 with no gap therebetween in the first and second embodiments, ends 6*s* of development blade 6 and first seal members 51 may be slightly spaced apart without being in contact with each other. In this case, second seal members 52 seal those spaces between ends 6*s* of development blade 6 and first seal members 51.

Although end 6*s* of development blade 6 is in tight contact with first seal member 51 in such a manner that the movement of development blade 6 is not excessively restricted by first seal members 51 in the first and second embodiments, end 6*s* of development blade 6 may be in soft contact with first seal member 51 with little reaction force therebetween. Moreover, although a printer is used as an example of the image formation apparatus in the first and second embodiments, the invention is not limited to this, and is also applicable to, for example, a copier, a facsimile machine, a multifunction device including these, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development device comprising:

a regulation member defining a part of a developer room and configured to regulate the thickness of a developer layer on a developer carrier, the regulation member including a regulation edge facing the developer carrier to control the thickness of the developer layer on the developer carrier, and an end facing an inner wall surface of the developer room;

a first seal member attached to the inner wall surface of the developer room at a position facing the end of the regulation member; and a second seal member attached to the regulation member at a portion in a vicinity of the end of the regulation member and being in contact with the first seal member to seal between the first seal member and the end of the regulation member, wherein the second seal member is lower in hardness than the first seal member, wherein the second seal member includes a bonded area that is bonded to the regulation member and an unbounded area that is not bonded to the regulation member.

2. The development device according to claim 1, wherein the regulation member includes a first main face exposed to an inside of the developer room and a second main face provided on an opposite side to the first main face and exposed to an outside of the developer room, and the second seal member is bonded to one of the first main face and the second main face in such a manner that a part of the second seal member sticks out from an end of the regulation member toward the first seal member.

3. The development device according to claim 2, wherein the one of the first main face and the second main face includes:

a bonded area where the second seal member is bonded; and an unbonded area where the second seal member is not bonded, wherein the unbonded area is provided closer to the end of the regulation member than the bonded area.

4. The development device according to claim 2, wherein the second seal member is bonded to the first main face.

5. The development device according to claim 1, wherein the end of the regulation member is in contact with the first seal member.

6. The development device according to claim 1, wherein the end of the regulation member is not in contact with the first seal member.

7. The development device according to claim 1, wherein the second seal member is not interposed between the first seal member and the end of the regulation member.

8. An image formation apparatus comprising:

an exposure device configured to emit light based on image data to form an electrostatic latent image;

the development device according to claim 1 configured to develop the electrostatic latent image formed by the exposure device, to form a developer image;

a transfer device configured to transfer the developer image onto a recording sheet; and a fixation device configured to fix the transferred developer image onto the recording sheet.

9. The image formation apparatus according to claim 8, wherein the regulation member includes a first main face exposed to an inside of the developer room and a second main face provided on an opposite side to the first main face and exposed to an outside of the developer room, and the second seal member is bonded to one of the first main face and the second main face in such a manner that a part of the second seal member sticks out from the end of the regulation member toward the first seal member.

10. The image formation apparatus according to claim 9, wherein the one of the first main face and the second main face includes:

a bonded area where the second seal member of the regulation member is bonded; and an unbonded area where the second seal member of the regulation member is not bonded, wherein the unbonded area is provided closer to the end of the regulation member than the bonded area.

11. The image formation apparatus according to claim 9, wherein the second seal member is bonded to the first main face.

12. The image formation apparatus according to claim 8, wherein the end of the regulation member is in contact with the first seal member.

13. The image formation apparatus according to claim 8, wherein the end of the regulation member is not in contact with the first seal member.

14. The image formation apparatus according to claim 8, wherein the second seal member is not interposed between the first seal member and the end of the regulation member.

15. The development device according to claim 1, wherein the bonded area of the second seal member is provided closer to the end of the regulation member than the unbonded area of the second seal member.

16. The image formation apparatus according to claim 8, wherein the bonded area of the second seal member is provided closer to the end of the regulation member than the unbonded area of the second seal member.

17. The development device according to claim 15, wherein the second seal member is bonded to the regulation member in such a manner that a part of the second seal member extends out from the end of the regulation member toward the first seal member.

18. The image formation apparatus according to claim 16, wherein the second seal member is bonded to the regulation member in such a manner that a part of the second seal member extends out from the end of the regulation member toward the first seal member.

19. The development device according to claim 17, wherein the unbonded area of the second seal member is in contact with the first seal member and is compressed by the first seal member in a direction opposite from the first seal member.

20. The image formation apparatus according to claim 18, wherein the unbonded area of the second seal member is in contact with the first seal member and is compressed by the first seal member in a direction opposite from the first seal member.

21. A development device comprising:

a regulation member defining a part of a developer room and configured to regulate the thickness of a developer layer on a developer carrier, the regulation member including a regulation edge facing the developer carrier to control the thickness of the developer layer on the developer carrier, and an end facing an inner wall surface of the developer room;

a first seal member attached to the inner wall surface of the developer room at a position facing the end of the regulation member; and a second seal member attached to the regulation member at a portion in a vicinity of the end of the regulation member and being in contact with the first seal member to seal between the first seal member and the end of the regulation member, wherein the second seal member is lower in hardness than the first seal member, wherein a surface of the second seal member in contact with the first seal member comprises a film member.

22. An image formation apparatus comprising:

an exposure device configured to emit light based on image data to form an electrostatic latent image;

the development device configured to develop the electrostatic latent image formed by the exposure device, to form a developer image, the development device comprising:

a regulation member defining a part of a developer room and configured to regulate the thickness of a developer layer on a developer carrier, the regulation member including a regulation edge facing the developer carrier to control the thickness of the developer layer on the developer carrier, and an end facing an inner wall surface of the developer room;

a first seal member attached to the inner wall surface of the developer room at a position facing the end of the regulation member; and a second seal member attached to the regulation member at a portion in a vicinity of the end of the regulation member and being in contact with the first seal member to seal between the first seal member and the end of the regulation member, wherein the second seal member is lower in hardness than the first seal member;

a transfer device configured to transfer the developer image onto a recording sheet; and a fixation device configured to fix the transferred developer image onto the recording sheet, wherein a surface of the second seal member in contact with the first seal member comprises a film member.

* * * * *